US005549509A

United States Patent [19]

Hirst et al.

[11] Patent Number: 5,549,509

[45] Date of Patent: Aug. 27, 1996

[54] GRINDING APPARATUS WITH TOUCH-TOP WORK SURFACE

[75] Inventors: Donald L. Hirst, Royal Oak; Richard K. Wiand, Orchard Lake, both of Mich.

[73] Assignee: Inland Craft Products Co., Madison Heights, Mich.

[21] Appl. No.: 271,135

[22] Filed: Jul. 6, 1994

[51] Int. Cl.[6] ..... B24B 9/10; B24B 7/08

[52] U.S. Cl. ..... 451/178; 451/358; 451/361; 451/411

[58] Field of Search ..... 451/7, 360, 361, 451/358, 178, 411, 177; 409/134, 135, 136, 137, 171

[56] References Cited

U.S. PATENT DOCUMENTS

| | | | |
|---|---|---|---|
| 3,902,279 | 9/1975 | Lookadoo | 457/178 |
| 3,968,728 | 7/1976 | Goldfarb et al. | 451/411 |
| 4,423,568 | 1/1984 | Gould | 457/178 |
| 4,516,357 | 5/1985 | Gach . | |
| 4,551,948 | 11/1985 | Kindig et al. | 457/412 |
| 5,345,726 | 9/1994 | Gach | 457/177 |

*Primary Examiner*—Timothy V. Eley
*Attorney, Agent, or Firm*—Harness, Dickey & Pierce, P.L.C.

[57] ABSTRACT

A grinding apparatus has a cylindrical grinding wheel assembly mounted on a vertical drive shaft extending from an electric motor through a horizontal work table. The apparatus includes a pressure sensitive electrical switch for activating the motor in response to downward force on the work table. The work table is supported on a housing adapted to contain the motor and can be interchanged with work tables of various sizes. The grinding wheel assembly has a drive half and a grinding wheel half driven by the drive shaft.

9 Claims, 2 Drawing Sheets

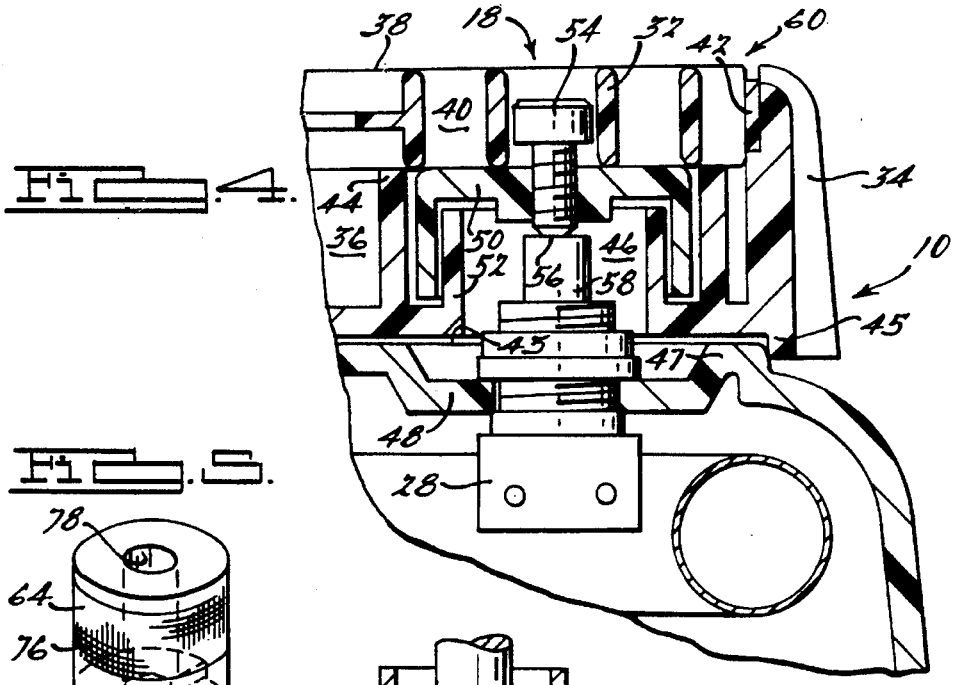
FIG. 4.
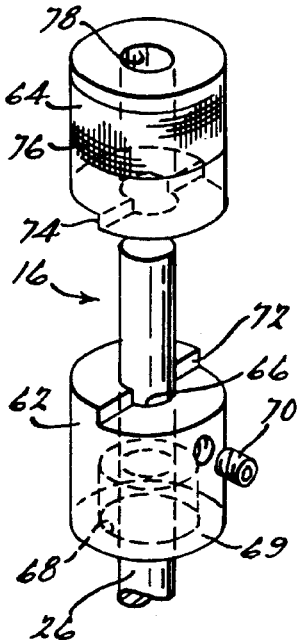
FIG. 5.
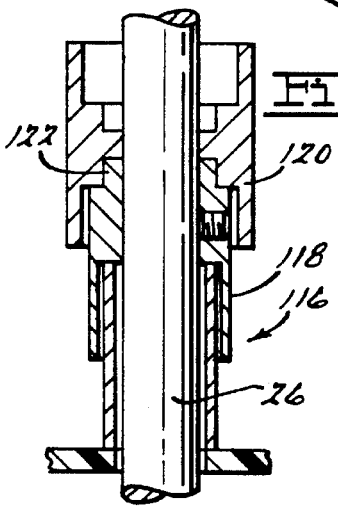
FIG. 6.
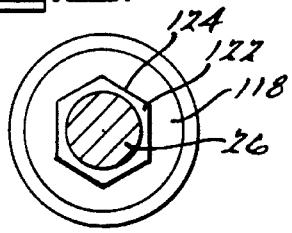
FIG. 7.
FIG. 8.
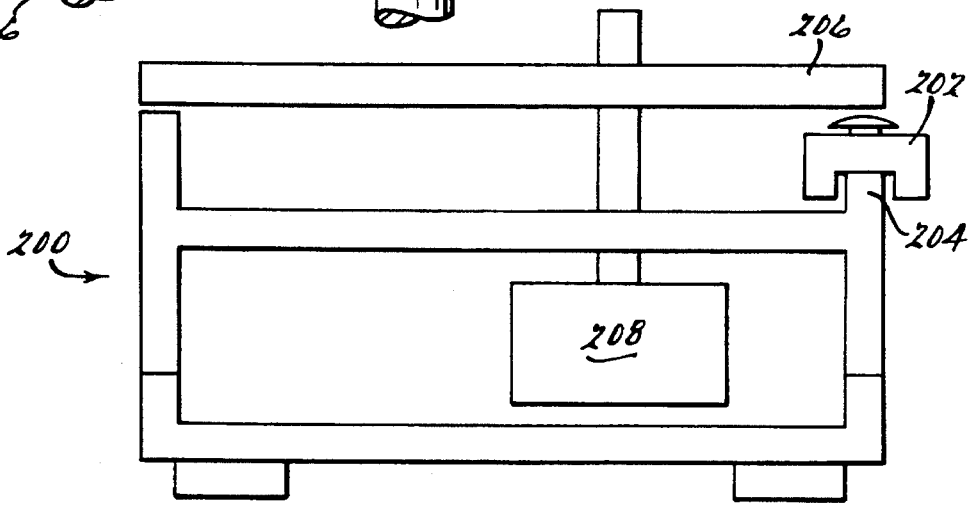

GRINDING APPARATUS WITH TOUCH-TOP WORK SURFACE

BACKGROUND OF THE INVENTION

The present invention relates to grinding machines having a cylindrical grinding wheel mounted on a vertical shaft extending through a horizontal work surface. More particularly, the present invention relates to such grinding machines having an improved work table and grinding wheel.

Grinding machines of the type of this invention primarily used for shaping pieces of stained glass for making glass windows although work pieces of other materials can also be ground to shape using such machines. Work pieces typically ground to shape include ones of glass, ceramic tile, stone, marble, fiberglass and plastic materials. In use, the work piece to be ground is placed on the work table and manually applied to the grinding wheel which is rotated by means of an electric motor. Power to the motor is switched on and off during periods of use and non-use of the machine by means of hand or foot operated switches. While these switches are functional, they sometimes distract one's eyes from the work piece and it would be desirable to have a more convenient and efficient means for activating and deactivating the motor.

It is often necessary to change the grinding wheel, for example, to one having a different abrasive grit or abrasive characteristic or to replace a wheel which has worn out. Grinding wheels are generally coaxially mounted on a vertical shaft driven by the electric motor and secured in place by means of a set screw. Replacement of the wheel simply involves loosening of the set screw, removing the old wheel, mounting the new wheel and then tightening the set screw on the new wheel. This procedure, while straight forward, is sometimes difficult or unpleasant because of ground glass or other material and coolant in the area of the set screw. Thus, it would be desirable to have a grinding wheel assembly which facilitates changing grinding wheels.

The grinding machines are used to grind work pieces having a wide variety of shapes and sizes. For most commonly used sizes of work pieces a regular sized work table is sufficiently large to support the work piece. However, for large work pieces it would be desirable if an oversized work table were available to be substituted for the regular work table.

Having the above points in mind, we have invented a new and improved grinding apparatus. Accordingly, the apparatus of the present invention has a touch-top work table which enables an operator to turn on the motor by applying slight downward force pressure on the table and to turn off the motor by not applying the downward force. The work table of the present invention can be easily interchanged with a larger work table. Furthermore, the grinding wheel device of the present invention facilitates removal of old wheels and installation of new wheels without he necessity of manipulating set screws.

Further understanding of the present invention will be had from the following detailed description and claims taken in conjunction with the accompanying drawings.

SUMMARY OF THE INVENTION

A grinding apparatus has a cylindrical grinding wheel assembly mounted on a vertical drive shaft extending from an electric motor through a horizontal work table. The apparatus includes a pressure sensitive electrical switch for activating the motor in response to downward force on the work table. The work table is supported on a housing adapted to contain the motor and can be interchanged with work tables of various sizes. The grinding wheel assembly has a drive half and a grinding wheel half driven by the drive shaft.

BRIEF DESCRIPTION OF THE DRAWINGS

FIG. 4 is a sectional view, broken away, taken along line 4—4 in FIG. 2;

FIG. 5 is an exploded perspective view, broken away, showing the grinding wheel assembly of FIG. 1;

FIG. 6 is a sectional view, broken away, showing an alternative embodiment of a grinding wheel assembly of the present invention;

FIG. 7 is a top plan view, with drive shaft in section, of the drive wheel half of FIG. 6; and FIG. 8 is a somewhat schematic side view of an alternative preferred embodiment of a grinding apparatus of the present invention.

DETAILED DESCRIPTION OF THE PREFERRED EMBODIMENT

Figure 1:
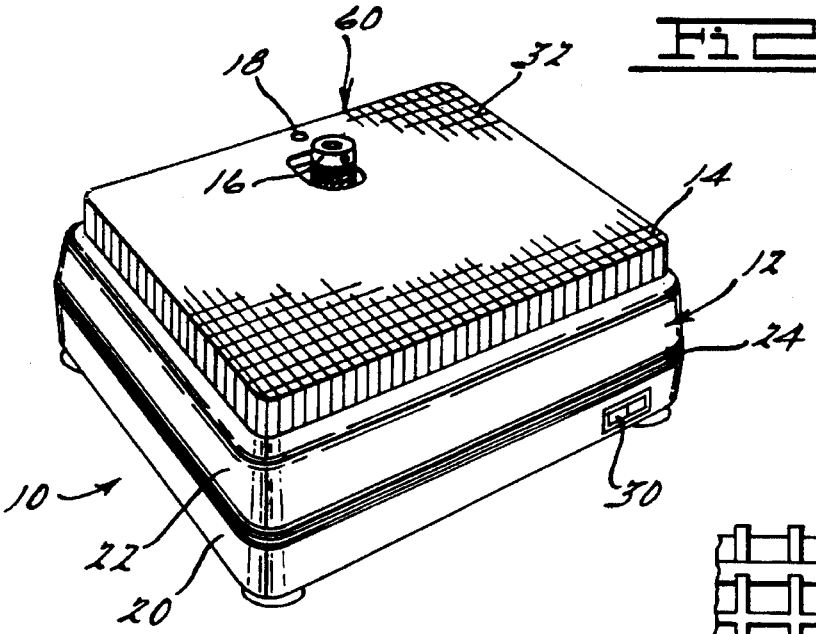
FIG. 1 is a perspective view of a preferred embodiment of a grinding apparatus of the present invention.
Figure 2:
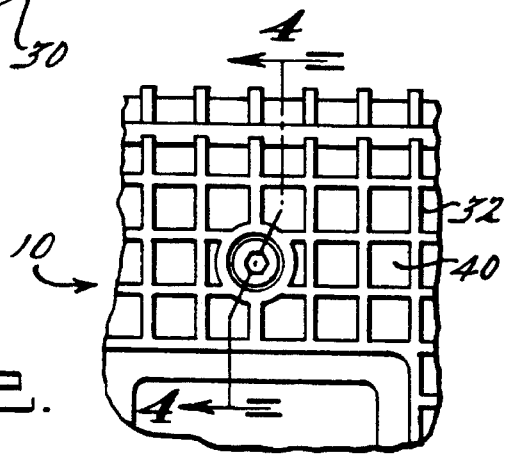
FIG. 2 is a plan view, broken away, showing the grinding wheel assembly of the apparatus of FIG. 1.

Now referring to the Figures, FIG. 1, 2, 4 and 5 show a preferred embodiment of a grinding apparatus of the present invention which is indicated generally by the numeral 10. Broadly speaking, grinding apparatus 10 comprises housing 12, work table 14, grinding wheel assembly 16 and electric switch means 18 for activating and deactivating an electric motor, not shown in the figures.

Housing 12 is made of molded thermoplastic material and comprises two half shells, 20 and 22, secured together with an elastomeric band 24 positioned therebetween. An electric motor is supported within housing 12 in a conventional manner and has drive shaft 26 which rotates to drive grinding wheel assembly 16. Thus, the electric motor, when switched "on" rotates drive shaft 26 to which grinding wheel assembly 16 is secured as will be described in more detail below. Housing 12 also supports work table 14 and two electrical switches, pressure sensitive electrical switch 28 and three position electrical switch 30. Electrical switches 28 and 30 are in electrical communication with an electrical power source and with the motor as will also be described in more detail below.

Figure 3:
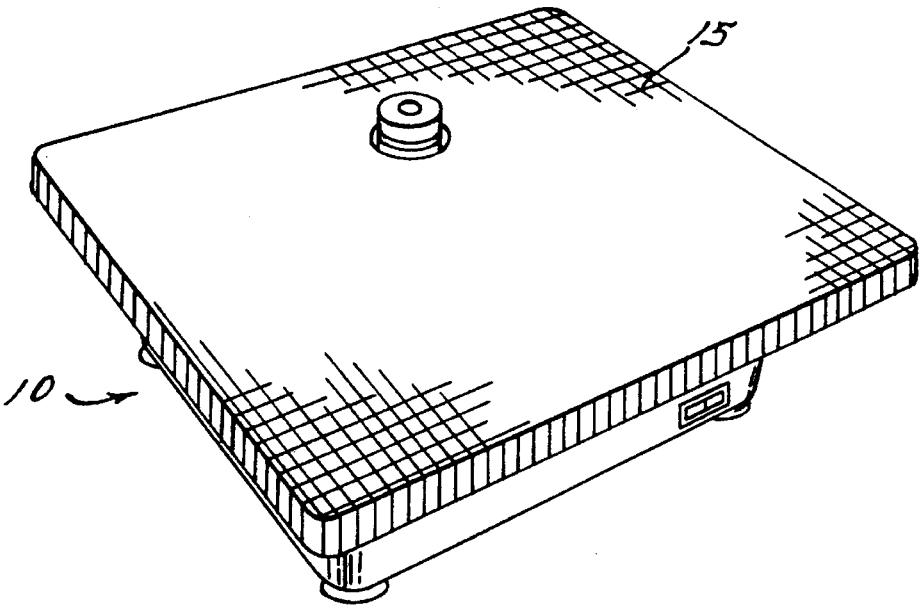
FIG. 3 is a perspective view showing a preferred embodiment of the present invention with an oversized work table.

Work table 14 is also made of molded thermoplastic material and has two parts, fiat screen 32 and base 34. Base 34 is a rectangular pan which provides reservoir 36 for retaining coolant water. Screen 32 provides work surface 38 for supporting work pieces to be ground and has a plurality of open holes or spaces 40 which allow liquid coolant and small solids to fall into reservoir 36. Screen 32 has an opening through which grinding wheel assembly 16 freely extends. The peripheral edges of screen 32 are supported by peripherally extending shoulder 42 on the side walls of base 34. Work table 14 is supported on fiat upper wall 43 of housing 12 and is maintained in position by lip 45 which extends around the under surface perimeter of work table 14 and overlaps a corresponding ridge 47 in top wall 48 of housing 12. Larger sizes of work tables can easily be interchanged with work table 14 as is illustrated by work table 15 in FIG. 3.

As is best shown in FIG. 4, an isolation wall 44 separates reservoir 36 and provides dry compartment 46 within base 34. Disposed partially within dry compartment 46 is electric switch means 18 for activating the electric motor which drives grinding wheel assembly 16. A pressure switch 28 is secured in top wall 48 of housing 12, extending upwardly therefrom into dry compartment 46 of base 34 of work table 14. A cup shaped member 50 is coaxially disposed over a cylindrically shaped wall 52 and threadably carries an adjustment screw 54. As is shown in FIG. 4, the end 56 of adjustment screw 54 is supported by rod 58 of pressure switch 28 which is spring biased upwardly. Thus, one side edge 60 of work table 14 is normally lifted slightly upwardly by pressure switch 28. But when sufficient downward force is applied to work surface 38 proximate to the edge 60 thereof to overcome the spring bias of pressure switch 28, then edge 60 of work table 16 will move downwardly and switch 28 will be activated to apply electrical power to the motor.

Electric switch means 18 includes pressure switch 28 and three position switch 30. It is contemplated that switches 28 and 30 will be connected between a source of electrical power and the motor so that switch 30 can be placed in a first, "off" position to prevent operation of the motor even if switch 28 is closed, a second position to provide operation of the motor only when switch 28 is closed and a third position to operate the motor regardless of the position of switch 28. A schematic is not shown as this circuitry is well within the skill of one of the art.

Now referring to FIG. 5, grinding wheel assembly 16 is well illustrated. Grinding wheel assembly 16 is shown in operative association with drive shaft 26 which is the drive shaft of an associated electric motor. Grinding wheel assembly 16 comprises a pair of cylindrically shaped elements, drive half 62 and grinding wheel 64. As is well illustrated in FIG. 5, drive half 62 has a cylindrically shaped bore 66 through which drive shaft 26 closely, but slidably extends. In addition, drive half 62 has a bore of larger diameter 68 which provides a skirt 69 to minimize coolant water splashing. A set screw 70 is used to secure drive half 62 to shaft 26. The top surface of drive half 62 has a shoulder 72 adapted to cooperate with a corresponding shoulder 74 in grinding wheel half 64 to drive grinding wheel half 64. Grinding wheel half 64 has a surface of suitable abrasive grit, such as diamond abrasive grit 76. Grinding wheel half 64 has a bore 78 which is adapted to closely, but slidably, fit over drive shaft 26. Thus, to change grinding wheels one can grasp grinding wheel half 64 and lift it upwardly off shaft 26 and then replace it with a different grinding wheel half on shaft 26 against drive half 62.

Now referring to FIGS. 6 and 7, an alternative form of a grinding wheel assembly is shown and indicated generally by the numeral 116. Grinding wheel assembly 116 has a drive half 118 and a grinding wheel 120. Drive half 118 is of a construction analogous to drive half 62 but has a projection 122 in its upper surface which as viewed in FIG. 7 has a hexagon shape to provide a plurality of shoulders 124 for driving a grinding wheel. Grinding wheel 120 has a corresponding shaped recess which cooperates with projection 122.

Now referring to FIG. 8, a retrofit kit for adapting a grinding apparatus to provide a touch-top work table which can operate an electric motor in a manner similar to the apparatus of FIG. 1 is shown. Thus, grinding apparatus 200 has a pressure switch 202 inserted between wall 204 and work table 206. Pressure switch 202 is electrically inserted between motor 208 and a power source such that upon the closing of pressure switch 202 by moving work table 206 downwardly the motor will operate.

It will be appreciated by those skilled in the art that the embodiments described herein before are preferred embodiments of the present invention but also are subject to modification and variation within the skill of those skilled in the art. It will also be appreciated by those skilled in the art that the present invention provides a grinding apparatus which allows activation and deactivation of the motor without the necessity of locating and manually activating a switch. Furthermore, the present invention offers several advantages including the advantage of economy since use of the pressure switch will activate the motor only when the grinding is actually being used and during periods of non-use the motor will be deactivated thereby saving electricity. The present apparatus provides easy "touch-up" grinding and fitting which is often required during a stained glass or mosaic project. Furthermore, the present invention enables a user to watch the grinding head and work piece at motor start up to reduce the possibility of an unnoticed work piece or a piece of an unnoticed work piece being thrown off the grinder at start up. The present invention will increase the useful life of a motor since the motor will not run when it is not being used. Furthermore, the present invention avoids the user activating an electrical switch with wet hands.

What is claimed is:

1. A grinding apparatus including a cylindrical grinding wheel mounted on a vertical drive shaft driven by an electric motor, said grinding apparatus comprising:

a housing, said housing including a top wall, said motor being rigidly secured with the housing and said drive shaft extending through the top wall;

a work table being supported on the top wall, said work table including a base, a work table top and a side wall defining a reservoir therebetween for holding a liquid; and means for activating the motor in response to downward force applied to the work table top, said means for activating including a pressure switch mounted in the top wall of the housing within the reservoir, said pressure switch including a spring-biased rod extending upwardly therefrom towards the work table top, said work table further including a cylindrical wall as part of an enclosure surrounding and enclosing the pressure switch within the reservoir, said cylindrical wall and enclosure defining a dry chamber within the reservoir that prevents liquid within the reservoir from contacting the pressure switch, wherein the means for activating further includes an adjustment screw threadably engaged through a cup member and contacting the spring-biased rod, said cup member being part of the enclosure, said adjustment screw being threadably engaged within the cup member so as to alter the position of the work table top relative to the top wall.

2. The apparatus of claim 1 including a grinding wheel assembly having a drive half and a grinding wheel half, said drive half being selectively coaxially fixed about said drive shaft and said grinding wheel half being axially slidably coaxially mounted on said shaft above said drive half, said drive half including an upwardly extending portion having a drive half mating face and said grinding wheel half having a downwardly extending portion having a grinding wheel mating face such that the mating face of the drive half and the mating face of the grinding wheel half engage so as to allow the grinding wheel half to rotate upon rotation of the drive half.

3. The apparatus of claim 2 wherein said drive half has at least one radially extending shoulder which is in abutting relationship with a corresponding shoulder on said grinding wheel half.

4. The apparatus of claim 2 wherein said drive half has an upwardly extending projection which fits into a corresponding recess in said grinding wheel half.

5. The apparatus of claim 2 wherein said drive half has a downwardly extending skirt.

6. The apparatus according to claim 1 wherein the work table top is a screen member supported on the side walls of the work table, said screen member allowing liquid and particulates to fall into the reservoir.

7. A grinding apparatus assembly including a cylindrical grinding wheel mounted on a vertical drive shaft driven by an electric motor, said apparatus assembly comprising:

a housing including a top wall, said motor being rigidly disposed within said housing and said drive shaft extending vertically through said top wall, said top wall including a ridge that extends vertically up from the top wall around the periphery of the top wall; and a first work table including a base portion, side walls and a work table top defining a reservoir therebetween for holding a liquid, said first work table being releasably secured to the top wall of the housing, said first work table including an extending lip that extends around the perimeter of the work table and where the lip is a downward extension of the side walls of the work table, said extending lip being aligned around an outside surface of the ridge extending from the top wall of the housing so as to position and hold the work table on the housing, said first work table being releasably secured to the top wall of the housing, said assembly further comprising a second work table of a larger size than the first work table, said second work table including an extending lip that is releasably securable to the top wall of the housing, wherein a work table top of the second work table has a larger surface area than the top wall of the housing.

8. The apparatus of claim 7 wherein said first and second work tables are releasably secured to the top wall of the housing.

9. The grinding apparatus according to claim 7 wherein the work table top of the first work table and the second work table are screen members supported on the side walls of the work tables, said screen members allowing liquid and particulates to fall into the reservoir.

* * * * *